US012722054B1

(12) United States Patent
Xie

(10) Patent No.: US 12,722,054 B1
(45) Date of Patent: Sep. 1, 2026

(54) GOLF CLUB STORAGE DEVICE

(71) Applicant: Meiling Xie, Xiamen (CN)

(72) Inventor: Meiling Xie, Xiamen (CN)

( * ) Notice: Subject to any disclaimer, the term of this patent is extended or adjusted under 35 U.S.C. 154(b) by 0 days.

(21) Appl. No.: 19/381,379

(22) Filed: Nov. 6, 2025

(30) Foreign Application Priority Data

Sep. 30, 2025 (CN) ..... 202522122130.9

(51) Int. Cl.
*A63B 55/40* (2015.01)

(52) U.S. Cl.
CPC ..... *A63B 55/40* (2015.10); *A63B 2209/08* (2013.01)

(58) Field of Classification Search
CPC ..... A63B 55/40; A63B 2209/08
USPC ..... 206/315.6
See application file for complete search history.

(56) References Cited

U.S. PATENT DOCUMENTS

2015/0018113 A1* 1/2015 Tan ..... A63B 55/40 473/282

FOREIGN PATENT DOCUMENTS

GB 2354454 A * 3/2001 ..... A63B 55/406

* cited by examiner

*Primary Examiner* — Nathan J Jenness
*Assistant Examiner* — Jessica Kavini Tamil
(74) *Attorney, Agent, or Firm* — RAYCHAN PATENT FIRM; Raymond Y Chan

(57) ABSTRACT

The present application relates to a golf club storage device configured to be mounted to a top of a golf bag. The top of the golf bag is provided with compartments. The golf club storage device includes a storage rack and a plurality of magnetic members. The storage rack is provided with a plurality of insertion slots in communication with the compartments of the golf bag, the insertion slots are configured for the insertion of golf clubs, and the golf bag is configured to accommodate shafts of the golf clubs; the magnetic members are mounted to the storage rack and configured to attract club heads of the golf clubs; and the magnetic members being disposed at intervals to form a plurality of placement areas configured for the placement of the club heads.

9 Claims, 5 Drawing Sheets

GOLF CLUB STORAGE DEVICE

CROSS REFERENCE OF RELATED APPLICATION

This application is a non-provisional application that claims the benefit of priority under 35U.S.C. § 119 to a Chinese application number 202522122130.9, filed Sep. 30, 2025, which is incorporated herewith by reference in its entirety.

BACKGROUND OF THE PRESENT INVENTION

Field of Invention

The present application relates to the technical field of sporting goods, and more particularly to a golf club storage device.

Description of Related Arts

In the sport of golf, players need to carry multiple golf clubs to play golf due to variations in shot distances and choices of fairways, and numerous golf clubs are stored in a golf bag. Currently on the market, the top of a golf bag is generally provided with a plurality of compartments divided by plastic plates, and a plurality of golf clubs are then stored in the compartments.

SUMMARY OF THE PRESENT INVENTION

The present application provides a golf club storage device, including:

a storage rack provided with a plurality of insertion slots in communication with the compartments of the golf bag, the insertion slots being configured for the insertion of golf clubs, and the golf bag being configured to accommodate shafts of the golf clubs; and a plurality of magnetic members mounted to the storage rack and configured to attract club heads of the golf clubs, the magnetic members being disposed at intervals to form a plurality of placement areas configured for the placement of the club heads.

Further, the storage rack may comprises a mounting rod, and the magnetic members are rotatably connected to the mounting rod.

Further, the magnetic member may comprises a mounting portion, the mounting rod is provided with a through hole, and the mounting portion is inserted into the through hole; and Further, the pivot shaft may be mounted to the mounting rod, and the pivot shaft passing through the mounting portion to rotatably connect the magnetic member and the mounting rod.

Further, the golf club storage device may comprise at least two mounting rods, wherein two adjacent mounting rods are spaced apart from each other to form the insertion slot, and each of the mounting rods is spaced apart from the compartments by a different distance, either of the mounting rods is provided with at least two magnetic members, and two adjacent magnetic members are spaced apart from each other to form the placement areas.

Further, a rotation range of the magnetic member relative to the mounting rod is 0° to 180°.

Further, any one of the magnetic members may comprise a shell internally provided with a mounting cavity, and a magnet is disposed in the mounting cavity.

Further, magnets for attracting the club heads of the golf clubs may be disposed at two ends of the mounting rod.

Further, any one of the magnetic members may comprise a shell, two mounting cavities are formed in the shell, the two mounting cavities are spaced apart from and opposite to each other, and a magnet is disposed in each mounting cavity.

Further, the golf club storage device may comprise a connecting member connected to the storage rack and the top of the golf bag respectively and configured to mount the storage rack on the golf bag.

Further, the connecting member may comprise two connecting brackets removably connected to two sides of the storage rack respectively, and an end of each of the two connecting brackets facing away from the storage rack is inserted into the top of the golf bag.

BRIEF DESCRIPTION OF THE DRAWINGS

In the drawings, unless otherwise specified, the same reference numerals across multiple drawings denote the same or similar parts or elements. These drawings are not necessarily drawn to scale. It should be understood that the drawings merely depict certain embodiments disclosed in the present invention and are not to be construed as limiting the scope of the present invention.

LIST OF REFERENCE NUMBERS

Figure 1:
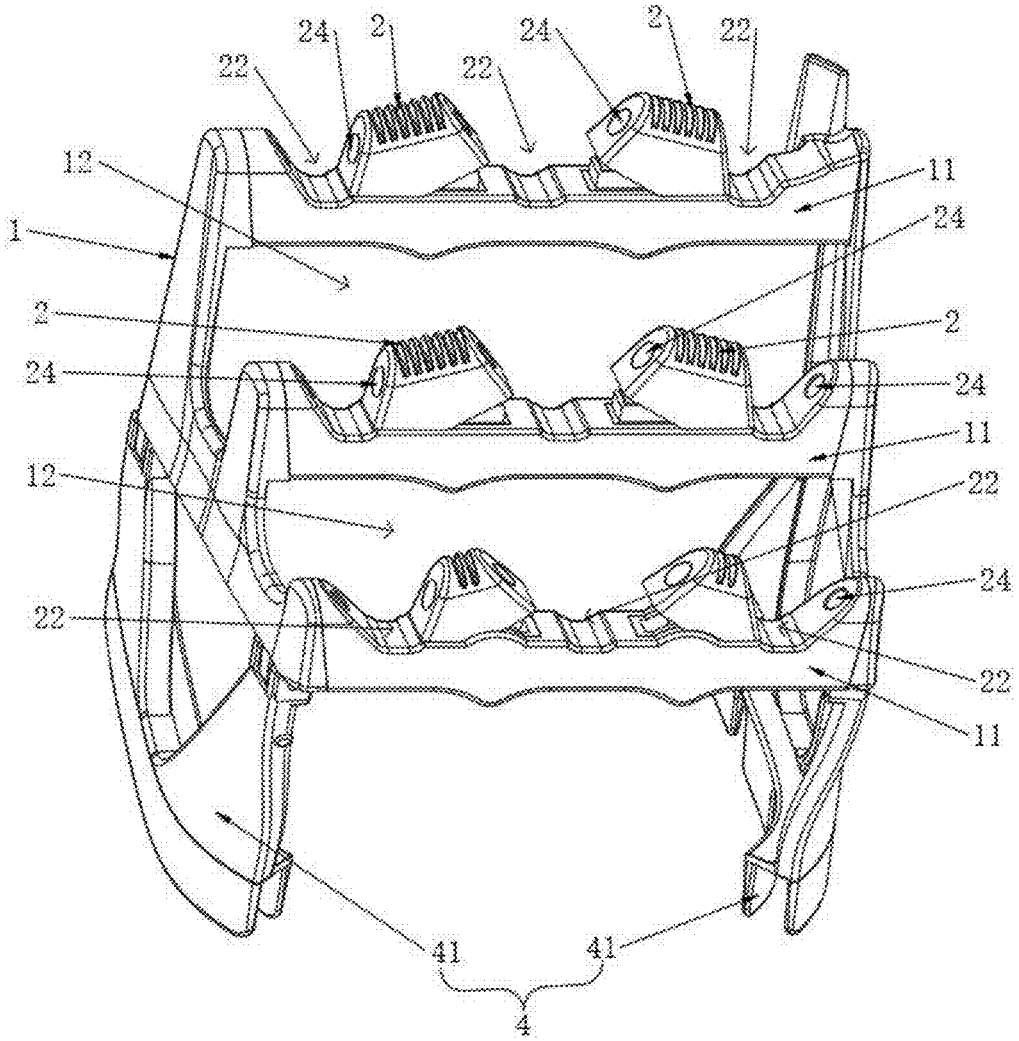
FIG. 1 is a schematic structural diagram of a golf club storage device according to an embodiment of the present application.

100, Golf club storage device; 1, Storage rack; 11, Mounting rod; 111, Through hole; 12, Insertion slot; 2, Magnetic member; 21, Mounting portion; 22, Placement area; 23, Shell; 231, Mounting cavity; 24, Magnet; 3, Pivot shaft; 4, Connecting member; 41, Connecting bracket; 5, Golf bag; 51, Compartment; 6, Golf club; 61, Shaft; 62, Club head.

DETAILED DESCRIPTION OF THE PREFERRED EMBODIMENT

The following discloses multiple embodiments of the technical solutions of the present invention. To simplify the disclosure, specific examples of elements and arrangements are described. These are merely examples and do not limit the scope of protection of the present invention. For example, where the specification describes that a first feature is formed "above" or "on" a second feature, it may include embodiments where the first and second features are directly connected, as well as embodiments where additional features intervene. Similarly, repeated use of reference numerals across examples is for brevity and clarity only and does not imply any relationship between embodiments. Furthermore, when an element is described as being "connected" or "coupled" to another element, this includes both direct and indirect connections or couplings through one or more intermediate elements.

The following only briefly describes certain exemplary embodiments. As those skilled in the art will recognize, various modifications may be made to the embodiments described without departing from the spirit or scope of the present invention. Therefore, the drawings and description are regarded as illustrative rather than restrictive.

Figure 2:
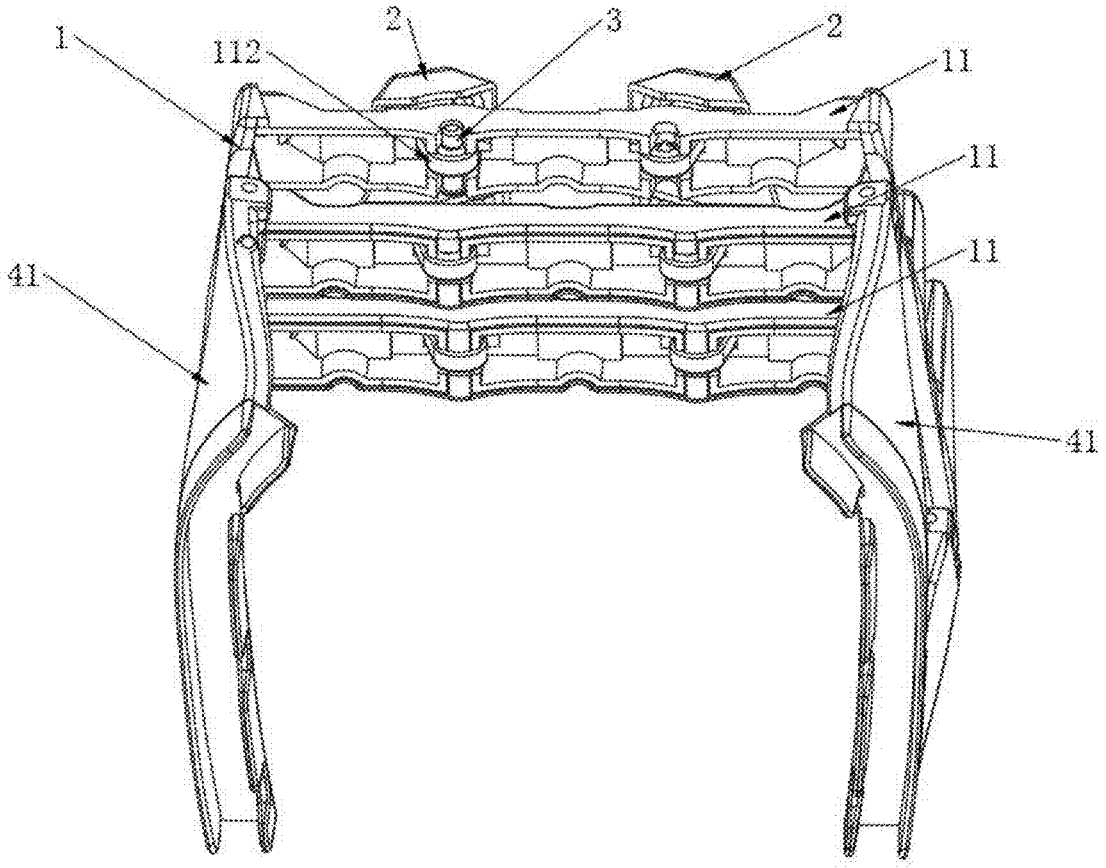
FIG. 2 is a schematic structural diagram of a golf club storage device according to an embodiment of the present application from another perspective.
Figure 3:
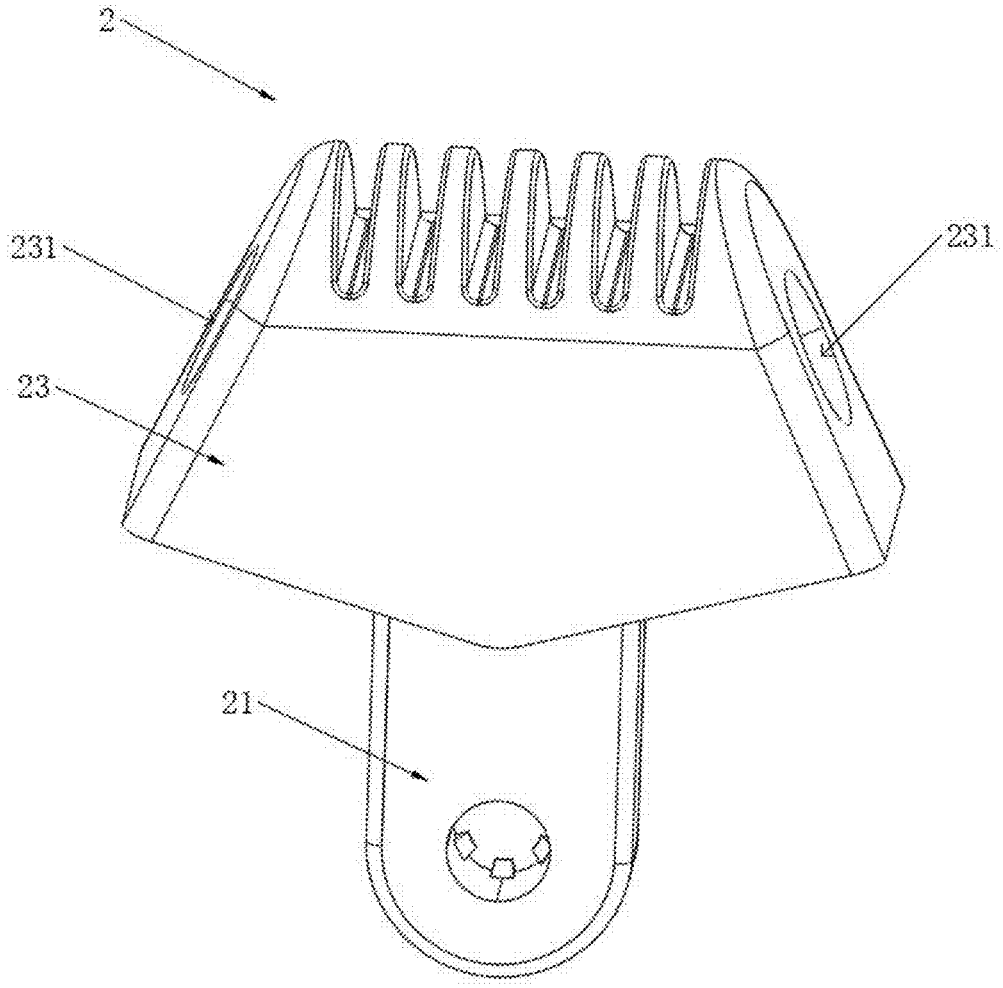
FIG. 3 is a schematic structural diagram of a magnetic member of a golf club storage device according to an embodiment of the present application.
Figure 4:
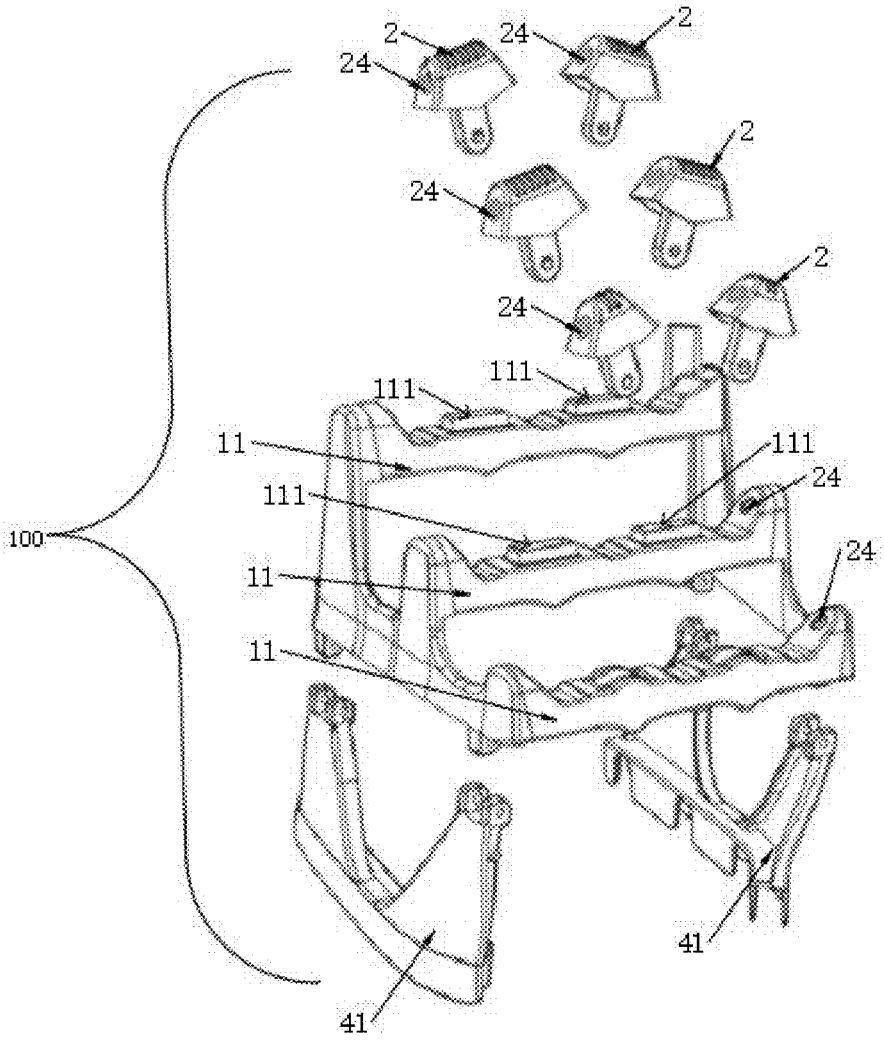
FIG. 4 is a schematic structural exploded view of a golf club storage device according to an embodiment of the present application.
Figure 5:
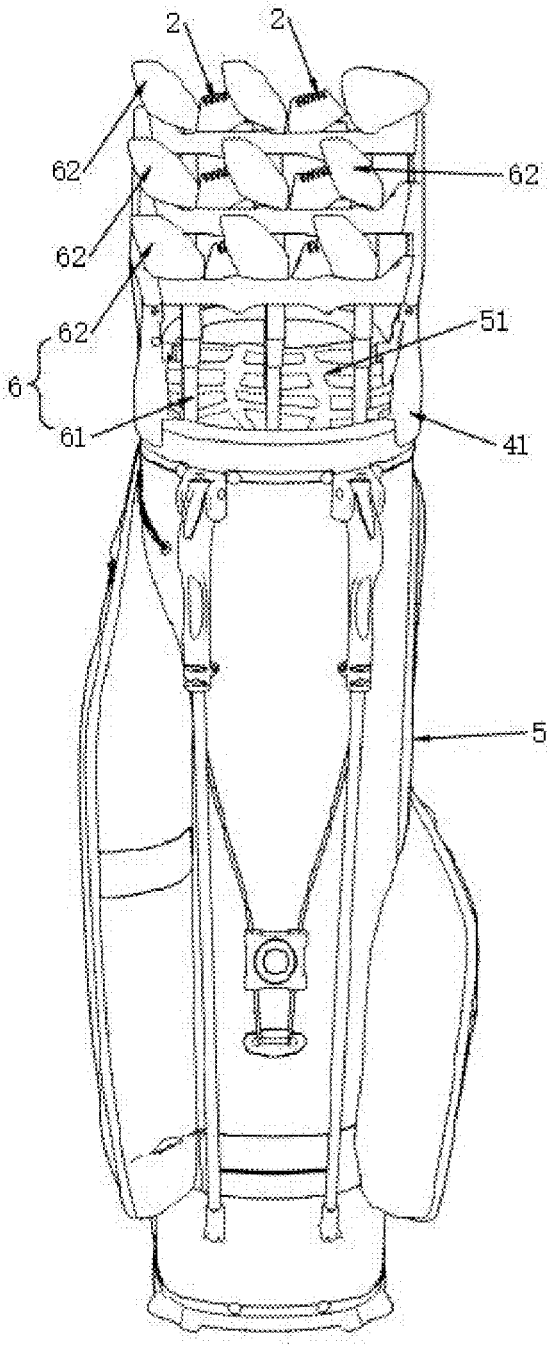
FIG. 5 is a schematic structural diagram of a golf club storage device, which is mounted to a top of a golf bag, according to an embodiment of the present application.

Referring to FIGS. 1 to 5, the present application provides a golf club storage device 100 configured to be mounted on a top of a golf bag 5. The top of the golf bag 5 is provided with compartments 51. The golf club storage device 100 includes a storage rack 1 and a plurality of magnetic members 2. The storage rack 1 is provided with a plurality of insertion slots 12 in communication with the compartments 51 of the golf bag 5, the insertion slots 12 are configured for the insertion of golf clubs 6, and the golf bag 5 is configured to accommodate shafts 61 of the golf clubs 6.

The magnetic members 2 are mounted to the storage rack 1 and configured to attract club heads 62 of the golf clubs 6. The magnetic members 2 are disposed at intervals to form a plurality of placement areas 22, and the placement areas 22 are configured to for the placement of the club heads 62.

In the golf club storage device 100 provided in the present application, the storage rack 1 is provided with the plurality of insertion slots 12 in communication with the compartments 51 of the golf bag 5, the insertion slots 12 are configured for the insertion of the golf clubs 6, the golf bag 5 is configured to accommodate the shafts 61 of the golf clubs 6, and the plurality of magnetic members 2 are mounted to the storage rack 1 and configured to attract the club heads 62 of the golf clubs 6; and the magnetic members 2 are disposed at intervals to form the plurality of placement areas 22 for the placement of the club heads 62. In this way, a user can insert the golf clubs 6 into the golf bag 5 from the storage rack 1, and the club heads 62 are attracted to the magnetic members 2 at the same time, so that the golf clubs 6 can be stored in different areas, and the club heads 62 of the golf clubs 6 can also be fixed, to effectively prevent the golf clubs 6 from colliding or rubbing against each other, thereby facilitating prolonging the service life of the golf clubs 6 and also reducing noise during transportation of the golf clubs 6.

Referring to FIGS. 1 to 5, according to the preferrde embodiment, the storage rack 1 includes a mounting rod 11, and the magnetic members 2 are rotatably connected to the mounting rod 11. The user can adjust angles of the magnetic members 2 according to his/her actual requirements, so that the magnetic members 2 can attract the golf clubs 6 placed at different angles and can also adapt to left-handed clubs and right-handed clubs of the golf clubs 6, and the storage device 100 is more compatible in use.

Specifically, the magnetic member 2 includes a mounting portion 21, the mounting rod 11 is provided with a through hole 111, and the mounting portion 21 is inserted into the through hole 111. The storage rack 1 further includes a pivot shaft 3. The pivot shaft 3 is mounted to the mounting rod 11, and the pivot shaft 3 passes through the mounting portion 21 to rotatably connect the magnetic member 2 and the mounting rod 11. In this way, the magnetic member 2 can rotate relative to the mounting rod 11 under the action of the pivot shaft 3.

Further, referring to FIGS. 1 to 5, at least two mounting rods 11 are provided, two adjacent mounting rods 11 are spaced apart from each other to form the insertion slot 12, and each of the mounting rods 11 is spaced apart from the compartments 51 by a different distance, either of the mounting rods 11 is provided with at least two magnetic members 2, and two adjacent magnetic members 2 are spaced apart from each other to form the placement areas 22. For example, three mounting rods 11 are provided, the three mounting rods 11 are parallelly disposed at intervals, two adjacent mounting rods 11 are spaced apart from each other to form the insertion slot 12, and the three mounting rods 11 are spaced apart from the compartments 51 by different distances, thereby facilitating matching with golf clubs 6 having different lengths.

Referring to FIGS. 1 to 5, according to the preferrde embodiment, a rotation range of the magnetic member 2 relative to the mounting rod 11 is 0° to 180°. Further, any one of the magnetic members 2 includes a shell 23, the shell 23 is internally provided with a mounting cavity 231, and a magnet 24 is disposed in the mounting cavity 231. The user can adjust the orientation of the magnet 24 by rotating the magnetic member 2, such that the magnet 24 correspondingly attaches the left-handed club or right-handed club, and the storage device 100 is thus more compatible in use.

Referring to FIGS. 1 to 5, according to the preferrde embodiment, magnets 24 for attracting the club heads 62 of the golf clubs 6 are disposed at two ends of the mounting rod 11 to facilitate the storage of more golf clubs 6. In addition to a rod body of a linear structure, the mounting rod 11 may use a rod body of a curved or annular structure, which is not specifically limited herein.

Referring to FIGS. 1 to 5, according to the preferrde embodiment, any one of the magnetic members 2 includes a shell 23, two mounting cavities 231 are formed in the shell 23, the two mounting cavities 231 are spaced apart from and opposite to each other, and a magnet 24 is disposed in each mounting cavity 231. In this way, both ends of the magnetic member 2 can attract the club heads 62 of the golf clubs 6, thereby facilitating the storage of more golf clubs 6. In some embodiments, four magnets 24 are disposed in different orientations in the magnetic member 2, to attract more club heads 62 and further increase the number of golf clubs 6 to be stored.

Referring to FIGS. 1 to 5, according to the preferrde embodiment, the golf club storage device 100 further includes a connecting member 4. The connecting member 4 is connected to the storage rack 1 and the top of the golf bag 5 respectively and configured to mount the storage rack 1 on the golf bag 5. Specifically, the connecting member 4 includes two connecting brackets 41, the two connecting brackets 41 are removably connected to two sides of the storage rack 1 respectively, and an end of the connecting bracket 41 facing away from the storage rack 1 is inserted into the top of the golf bag 5. The two connecting brackets 41 can be mounted on the two sides of the storage rack 1 by means of screwing or snap-fitting, and the connecting brackets 41 are inserted into the top of the golf bag 5 and configured to quickly mount the storage rack 1 on the golf bag 5, so that the mounting method is more convenient and quicker. In other embodiments, the connecting member 4 may be a screw, a snap-fit fastener, etc., which are not specifically limited herein.

The above technical solution has at least the following advantages and beneficial effects.

In the golf club storage device 100 provided in the present application, the storage rack 1 is provided with the plurality of insertion slots 12 in communication with the compartments 51 of the golf bag 5, the insertion slots 12 are configured for the insertion of the golf clubs 6, the golf bag 5 is configured to accommodate the shafts 61 of the golf clubs 6, and the plurality of magnetic members 2 are mounted to the storage rack 1 and configured to attract the club heads 62 of the golf clubs 6; and the magnetic members 2 are disposed at intervals to form the plurality of placement areas 22 for the placement of the club heads 62. In this way, a user can insert the golf clubs 6 into the golf bag 5 from the storage rack 1, and the club heads 62 are attracted to the magnetic members 2 at the same time, so that the golf clubs 6 can be stored in different areas, and the club heads 62 of the golf clubs 6 can also be fixed, to effectively prevent the golf clubs 6 from colliding or rubbing against each other, thereby facilitating prolonging the service life of the golf clubs 6 and also reducing noise during transportation of the golf clubs 6.

In the golf club storage device 100 provided in the present application, the magnetic members 2 are rotatably connected to the mounting rod 11 of the storage rack 1, and the user can adjust angles of the magnetic members 2 according to his/her actual requirements, so that the magnetic members 2 can attract the golf clubs 6 placed at different angles and can also adapt to left-handed clubs and right-handed clubs of the golf clubs 6, and the storage device 100 is more compatible in use.

In the golf club storage device 100 provided in the present application, the connecting brackets 41 are inserted into the top of the golf bag 5 and configured to quickly mount the storage rack 1 on the golf bag 5, so that the mounting is more convenient and quicker.

In the description of the present invention, references to the terms "one embodiment," "some embodiments," "example," "specific example," or "some examples" mean that the described features, structures, materials, or characteristics are included in at least one embodiment or example. Moreover, the described features, structures, materials, or characteristics may be combined in any suitable way in one or more embodiments or examples. Further, unless otherwise contradictory, different embodiments or examples and their features may be combined.

Additionally, the terms "first," "second," etc. are used for descriptive purposes only and should not be construed as indicating relative importance or implying any limitation on the number of features. Features described as "first" or "second" may include one or more such features. In the description of the present invention, the term "plurality" means two or more, unless specifically defined otherwise.

The foregoing are merely specific embodiments of the present invention and do not limit its protection scope. Any person skilled in the art can easily conceive of various modifications or substitutions within the scope of the disclosed technical solution, and these should all fall within the scope of protection of the present invention. Therefore, the scope of protection shall be defined by the appended claims.

What is claimed is:

1. A golf club storage device configured to be mounted to a top of a golf bag, the top of the golf bag being provided with compartments, the golf club storage device comprising:

a storage rack provided with a plurality of insertion slots in communication with the compartments of the golf bag, the insertion slots being configured for the insertion of golf clubs, and the golf bag being configured to accommodate shafts of the golf clubs, wherein the storage rack comprises a mounting rod; and a plurality of magnetic members mounted to the storage rack and configured to attract club heads of the golf clubs respectively, wherein the magnetic members are rotatably connected to the mounting rod and disposed at intervals to form a plurality of placement areas configured for the placement of the club heads.

2. The golf club storage device according to claim 1, wherein the magnetic member comprises a mounting portion, the mounting rod is provided with a through hole, and the mounting portion is inserted into the through hole; and the storage rack further comprises a pivot shaft, the pivot shaft being mounted to the mounting rod, and the pivot shaft passing through the mounting portion to rotatably connect the magnetic member and the mounting rod.

3. The golf club storage device according to claim 1, wherein at least two mounting rods are provided, two adjacent mounting rods are spaced apart from each other to form the insertion slot, and each of the mounting rods is spaced apart from the compartments by a different distance, either of the mounting rods is provided with at least two magnetic members, and two adjacent magnetic members are spaced apart from each other to form the placement areas.

4. The golf club storage device according to claim 1, wherein a rotation range of the magnetic member relative to the mounting rod is 0° to 180°.

5. The golf club storage device according to claim 4, wherein any one of the magnetic members comprises a shell internally provided with a mounting cavity, and a magnet is disposed in the mounting cavity.

6. The golf club storage device according to claim 1, wherein magnets for attracting the club heads of the golf clubs are disposed at two ends of the mounting rod.

7. The golf club storage device according to claim 1, wherein any one of the magnetic members comprises a shell, two mounting cavities are formed in the shell, the two mounting cavities are spaced apart from and opposite to each other, and a magnet is disposed in each mounting cavity.

8. The golf club storage device according to claim 1, further comprising a connecting member connected to the storage rack and the top of the golf bag respectively and configured to mount the storage rack on the golf bag.

9. The golf club storage device according to claim 8, wherein the connecting member comprises two connecting brackets removably connected to two sides of the storage rack respectively, and an end of each of the two connecting brackets facing away from the storage rack is inserted into the top of the golf bag.

* * * * *